US008366161B1

(12) United States Patent
Schuler

(10) Patent No.: US 8,366,161 B1
(45) Date of Patent: Feb. 5, 2013

(54) MULTIPLE POT CARRY DEVICE

(76) Inventor: Glenn E. Schuler, Osage, IA (US)

( * ) Notice: Subject to any disclaimer, the term of this patent is extended or adjusted under 35 U.S.C. 154(b) by 192 days.

(21) Appl. No.: 13/018,621

(22) Filed: Feb. 1, 2011

(51) Int. Cl.
*A45F 5/00* (2006.01)

(52) U.S. Cl. ..... 294/87.2; 294/103.1; 294/145; 294/162; 294/165

(58) Field of Classification Search ..... 294/87.1, 294/87.2, 87.26, 90, 103.1, 145, 159, 162–166, 294/27.1, 34; 220/23.4
See application file for complete search history.

(56) References Cited

U.S. PATENT DOCUMENTS 193,479 A * 7/1877 Burgin ..... 294/67.1
2,362,331 A * 11/1944 Weber ..... 294/159
3,760,974 A * 9/1973 Oglesbee ..... 206/427
3,852,912 A 12/1974 Diller
4,262,795 A * 4/1981 Hecker ..... 198/803.7
4,277,006 A * 7/1981 Pinckard ..... 294/145
4,925,015 A * 5/1990 Vaida et al. ..... 198/803.7
5,481,825 A 1/1996 Aoyama
6,312,032 B1 * 11/2001 Richardson ..... 294/87.2
6,523,874 B1 * 2/2003 Edmeyer et al. ..... 294/87.2
2004/0251703 A1 12/2004 Griffith et al.

* cited by examiner

*Primary Examiner* — Dean Kramer

(57) ABSTRACT

The multiple pot carry device provides for carrying multiple plant pots with one hand, with substantially automatic pot lip engagement retained until released by a user. Ease of pot engagement and disengagement are key features of the device. The device is not limited to three clamps pivotally suspended from the carry bar. Clamps are substantially automatic in engagement and disengagement with pot lips.

16 Claims, 4 Drawing Sheets

MULTIPLE POT CARRY DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Carrying multiple plant pots is pretty much impossible, other than perhaps two pots at one time, one in each hand. Yet the need to carry multiple pots with one hand often arises, especially for those who are professionals in the plant industry. The present apparatus provides for secure multiple pot carry with one hand.

FIELD OF THE INVENTION

The multiple pot carry device relates to devices for carrying plant pots.

SUMMARY OF THE INVENTION

The general purpose of the multiple pot carry device, described subsequently in greater detail, is to provide a multiple pot carry device which has many novel features that result in an improved multiple pot carry device which is not anticipated, rendered obvious, suggested, or even implied by prior art, either alone or in combination thereof.

To attain this, the multiple pot carry device provides for carrying multiple plant pots with one hand, with substantially automatic pot lip engagement retained until released by a user. Ease of pot engagement and disengagement are key features of the device. The ideal embodiment of the device may comprise a compression spring held between a spring stop and a disc, around the vertical arm. A more basic embodiment of the device may exclude the spring stop, disc, and spring and rely solely upon the sleeve with diametrically opposed angled vertical arms and the horizontal clamp bar disposed downwardly on the vertical arm. Yet another version may include the disc to limit upward travel of the sleeve. The vertical arm may be pivotally suspended from the bar. The bar may be cylindrical for greater grip and carry comfort. The device is not limited to three clamps per bar. The vertical arms may be pivotally suspended from the bar for greater convenience in use and for greater flexibility in application to various pot sizes. The angled vertical arms may be straight, without the angle lending the clamps to easier use.

Thus has been broadly outlined the more important features of the improved multiple pot carry device so that the detailed description thereof that follows may be better understood and in order that the present contribution to the art may be better appreciated.

An object of the multiple pot carry device is to provide for carrying multiple plant pots with one hand.

Another object of the multiple pot carry device is to provide for easily engaging pots with the device.

A further object of the multiple pot carry device is to provide for easily disengaging pots.

An added object of the multiple pot carry device is to provide secure pot carry.

And, an object of the multiple pot carry device is to substantially automatically clamp a pot.

These together with additional objects, features and advantages of the improved multiple pot carry device will be readily apparent to those of ordinary skill in the art upon reading the following detailed description of presently preferred, but nonetheless illustrative, embodiments of the improved multiple pot carry device when taken in conjunction with the accompanying drawings.

DETAILED DESCRIPTION OF THE DRAWINGS

Figure 1:
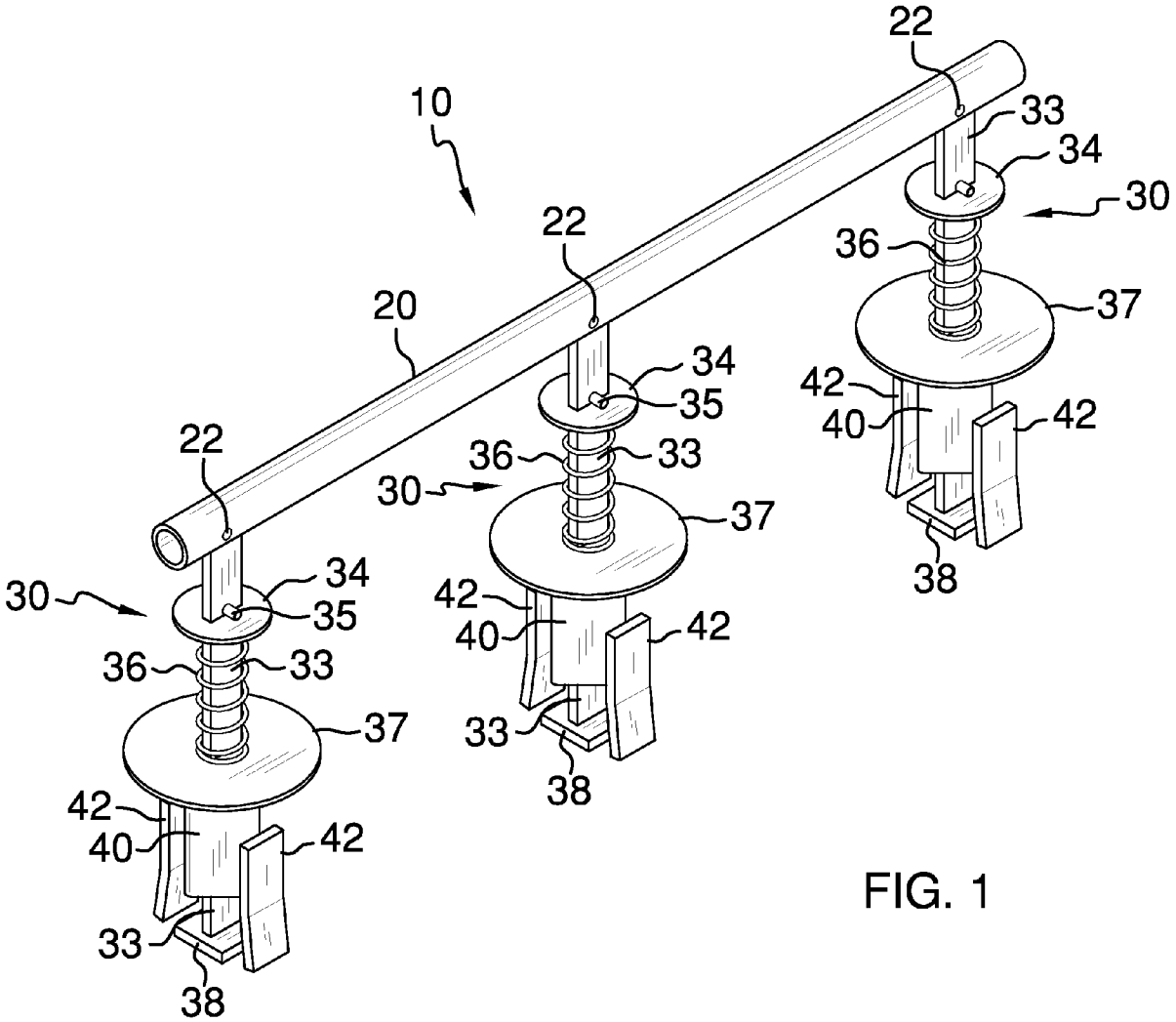
FIG. 1 is a perspective view.
Figure 2:
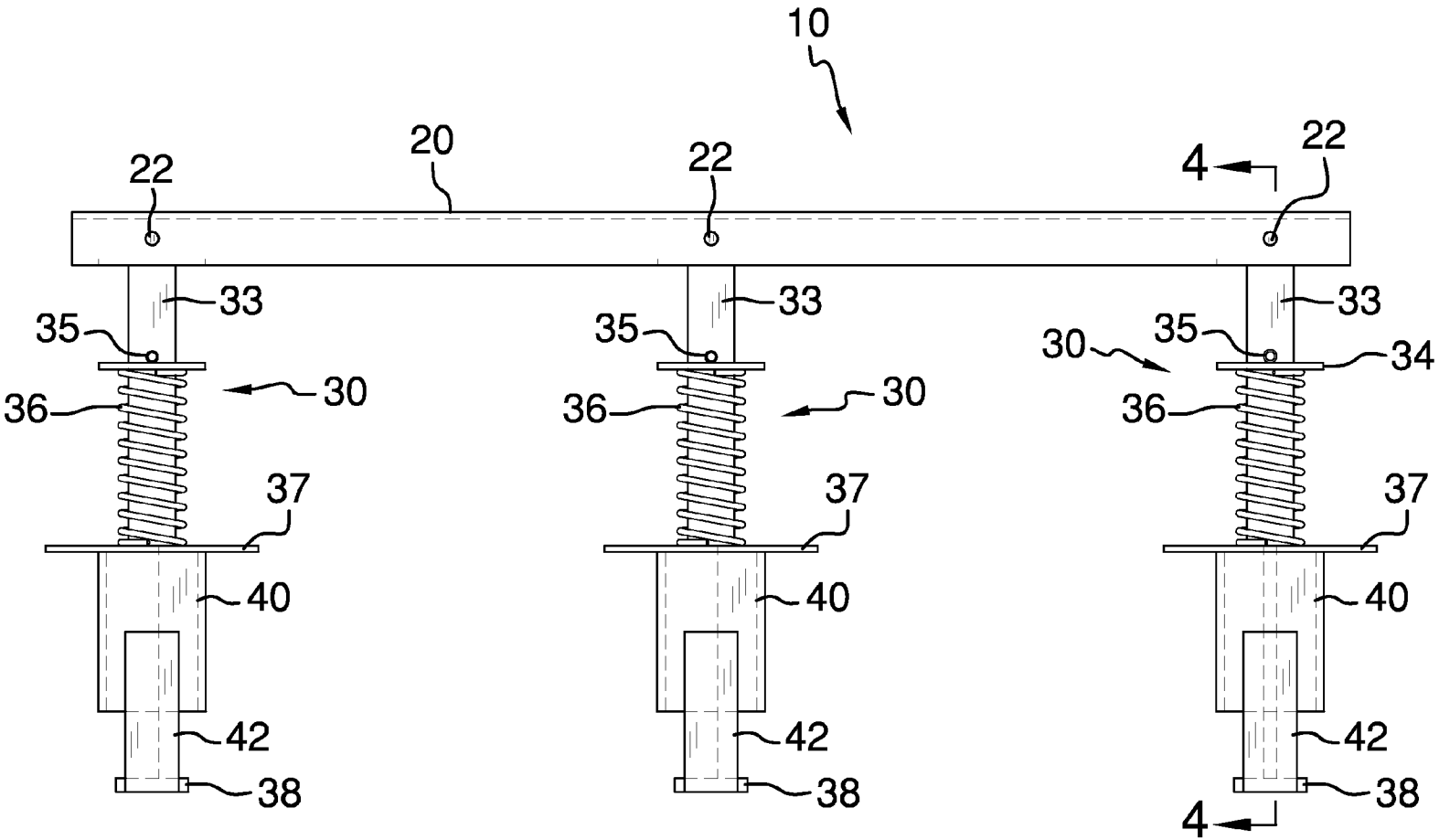
FIG. 2 is a lateral elevation view.
Figure 3:
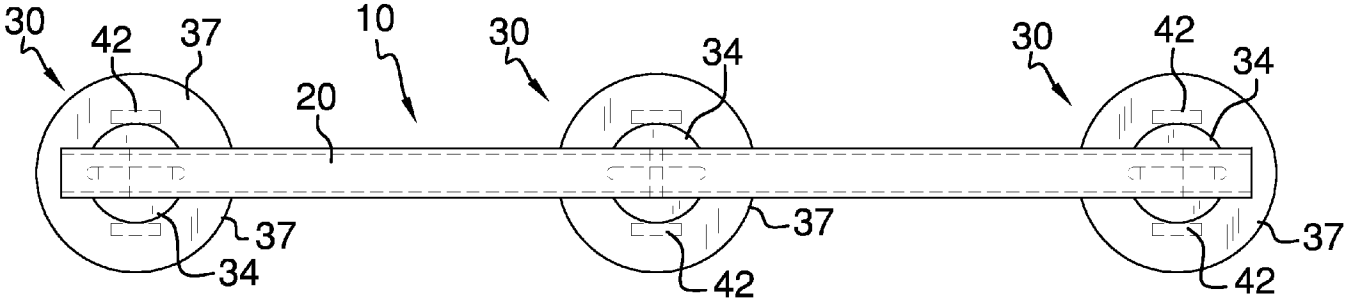
FIG. 3 is a top plan view.
Figure 4:
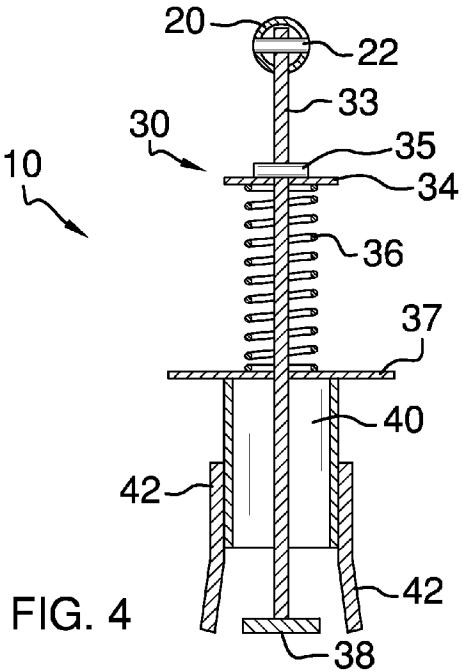
FIG. 4 is a partial cross sectional view of FIG. 2, taken along the line 4-4.

With reference now to the drawings, and in particular FIGS. 1 through 5B thereof, the principles and concepts of the multiple pot carry device generally designated by the reference number 10 will be described. Referring to FIG. 3, the device 10 partially comprises the horizontally disposed bar 20.

Referring to FIG. 2, the plurality of spaced apart clamps 30 is disposed downwardly along the bar 20.

Referring to FIG. 1, each clamp 30 comprises a vertical arm 33 pivotally affixed to the bar 20 via a pivot pin 22. A spring stop 34 is disposed around the vertical arm 33, most proximal to the bar 20. A disc 37 is slideably disposed on the vertical arm 33. The disc 37 is spaced apart from the spring stop 34.

Referring to FIG. 4 and again to FIG. 1, the compression spring 36 is disposed around the vertical arm 33 between the spring stop 34 and the disc 37. A roll pin 35 secures the spring stop 34 downwardly against the compression spring 36. A sleeve 40 is disposed around the vertical arm 33 below the disc 37. A pair of diametrically disposed identical angled arms 42 extend downwardly from the sleeve 40. A horizontal clamp bar 38 extends in a horizontal plane from a distal end of the vertical arm 33.

Figure 5B:
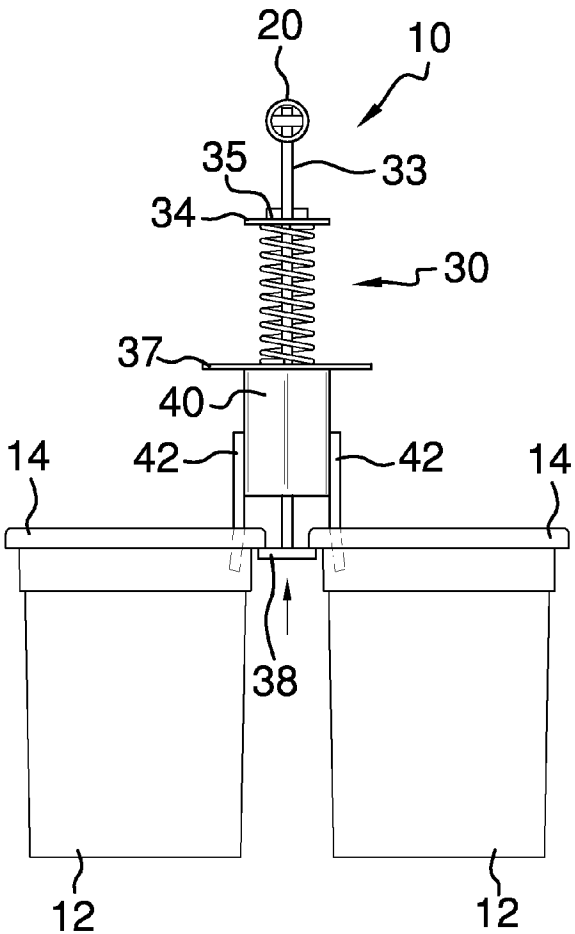
FIG. 5B is an in-use lateral elevation view, with clamp engaged with the pot lips.
Figure 5A:
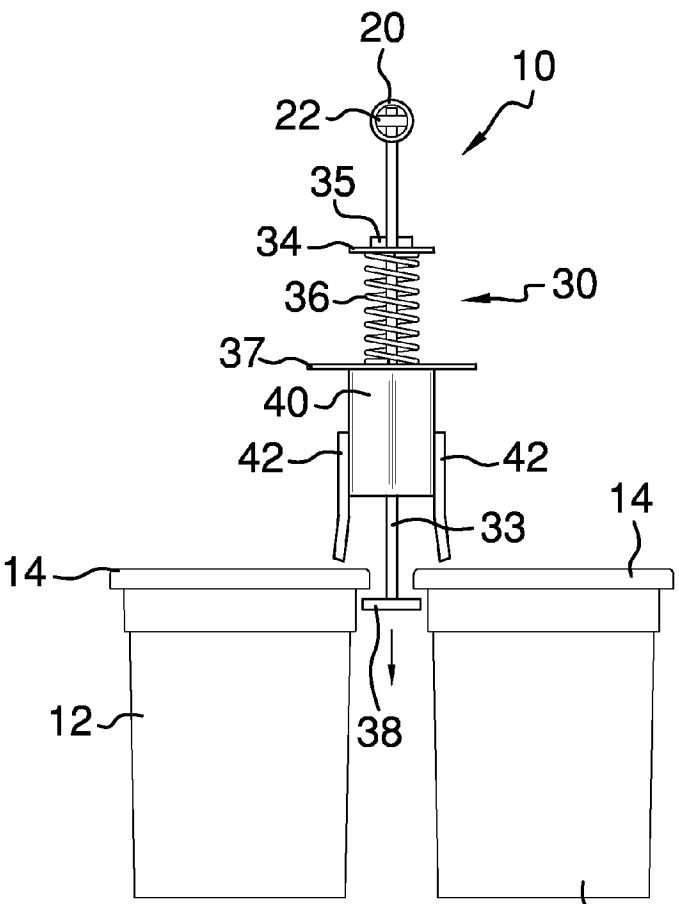
FIG. 5A is an in-use lateral elevation view, with clamp not yet engaged with the pot lips.

Referring to FIG. 5A, the clamp 30 is ready to engage the pair of existing pot 12 lips 14.

Referring to FIG. 5B, the horizontal clamp bar 38 and the angled arms 42 have selectively and removably engaged a pair of lips 14 of a pair of existing pots 12. The entirety may be lifted by the bar 20 for conveyance, with the clamps 30 automatically remaining engaged with the pot 12 lips 14 until disengaged by the user by pushing downwardly on the bar 20 and hence the vertical arm 33. Pot 12 lips 14 may then be removed from the clamp 30. A simple lateral movement is all that is required to release the pot 12 lips 14.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the multiple pot carry device may be used.

What is claimed is:

1. A multiple pot carry device comprising, in combination:
a horizontal bar;
a plurality of spaced apart clamps disposed downwardly along the bar, each clamp comprising:
a vertical arm affixed to the bar;
a sleeve disposed around the vertical arm;
a pair of diametrically disposed identical angled arms extended downwardly from the sleeve;
a horizontal clamp bar extended in a horizontal plane from a distal end of the vertical arm;
whereby the horizontal clamp bar and the angled vertical arms selectively and removably engage a pair of lips of a pair of existing pots.

2. The device according to claim 1 further comprising a disc slideably disposed on the vertical arm, the disc limiting an upward travel of the sleeve.

3. The device according to claim 2 further comprising a roll pin limiting an upward travel of the disc.

4. The device according to claim 3 wherein the vertical arm is further pivotally affixed to the bar via a pivot pin.

5. The device according to claim 4 wherein the bar is further cylindrical.

6. The device according to claim 3 wherein the bar is further cylindrical.

7. The device according to claim 2 wherein the vertical arm is further pivotally affixed to the bar via a pivot pin.

8. The device according to claim 7 wherein the bar is further cylindrical.

9. The device according to claim 2 wherein the bar is further cylindrical.

10. The device according to claim 1 wherein the vertical arm is further pivotally affixed to the bar via a pivot pin.

11. The device according to claim 10 wherein the bar is further cylindrical.

12. The device according to claim 1 wherein the bar is further cylindrical.

13. A multiple pot carrying device comprising, in combination:
a horizontal bar;
a plurality of spaced apart clamps disposed downwardly along the bar, each clamp comprising:
a vertical arm pivotally affixed to the bar via a pivot pin;
a spring stop disposed around the vertical arm, most proximal to the bar;
a disc slideably disposed on the vertical arm, the disc spaced apart from the spring stop;
a compression spring disposed around the vertical arm between the spring stop and the disc;
a roll pin securing the spring stop downwardly against the compression spring;
a sleeve disposed around the vertical arm below the disc;
a pair of diametrically disposed identical angled arms extended downwardly from the sleeve;
a horizontal clamp bar extended in a horizontal plane from a distal end of the vertical arm;
whereby the horizontal clamp bar and the angled vertical arms selectively and removably engage a pair of lips of a pair of existing pots.

14. The device according to claim 13 wherein the bar is further cylindrical.

15. The device according to claim 14 wherein the vertical arm further comprises flat stock.

16. The device according to claim 13 wherein the vertical arm further comprises flat stock.

* * * * *